US011325683B2

(12) United States Patent
Fleming, Jr. et al.

(10) Patent No.: US 11,325,683 B2
(45) Date of Patent: May 10, 2022

(54) URINAL FOR A BOAT

(71) Applicant: Pee at Sea, Inc, Tampa, FL (US)

(72) Inventors: James Preston Fleming, Jr., Wesley Chapel, FL (US); Trevor Scott Abernathy, Tampa, FL (US)

(73) Assignee: Pee at Sea, Inc., Tampa, FL (US)

( * ) Notice: Subject to any disclaimer, the term of this patent is extended or adjusted under 35 U.S.C. 154(b) by 109 days.

(21) Appl. No.: 16/913,123

(22) Filed: Jun. 26, 2020

(65) Prior Publication Data

US 2020/0407025 A1 Dec. 31, 2020

Related U.S. Application Data

(60) Provisional application No. 62/868,338, filed on Jun. 28, 2019.

(51) Int. Cl.
*B63B 29/14* (2006.01)

(52) U.S. Cl.
CPC ..... *B63B 29/14* (2013.01)

(58) Field of Classification Search
CPC ..... B63B 29/14; B63B 29/16; B63B 17/00; B63B 17/06; B63B 13/00; B63B 69/00; A47K 11/12; A61F 5/4556; A61G 9/006
USPC ..... 114/343, 364; 4/144.1
See application file for complete search history.

(56) References Cited

U.S. PATENT DOCUMENTS

| | | | | |
|---|---|---|---|---|
| 3,742,522 | A * | 7/1973 | Stevenson | E03D 13/00 4/307 |
| 4,670,918 | A * | 6/1987 | Juaire | A47K 4/00 4/462 |
| D341,193 | S * | 11/1993 | Hart | A47K 11/12 D23/302 |
| 9,598,174 | B2 * | 3/2017 | Schliwa | B64D 11/02 |
| 10,555,645 | B1 * | 2/2020 | Danti | A47K 11/12 |
| 2010/0145288 | A1 * | 6/2010 | Mathews | A61G 9/006 604/317 |
| 2019/0282043 | A1 * | 9/2019 | Luster | B60R 15/04 |

FOREIGN PATENT DOCUMENTS

| | | | | |
|---|---|---|---|---|
| CA | 2302435 | A1 * | 9/2001 | A47K 11/12 |

* cited by examiner

*Primary Examiner* — Daniel V Venne
(74) *Attorney, Agent, or Firm* — Larson & Larson, P.A.; Frank Liebenow; Justin P. Miller

(57) ABSTRACT

A urinal for a boat includes an outer shell that has an enlarged opening for accepting liquids (e.g. urine) and a drain. The drain is interfaced to an opening on a bottom surface of the outer shell for draining the liquids away from the boat. In some embodiments, there is a support unit for installing the urinal into an orifice (e.g. fishing pole holder) of the boat.

13 Claims, 1 Drawing Sheet

URINAL FOR A BOAT

CROSS-REFERENCE TO RELATED APPLICATION

This application claims the benefit of U.S. provisional application No. 62/868,338 filed on Jun. 28, 2019, the disclosure of which are incorporated by reference.

FIELD

The present invention relates to urinals and, more particularly, to a portable urinal for a boat.

BACKGROUND

It is often desired to urinate when boating, especially when fishing for long periods of time. Many pleasure crafts have no facilities for relieving oneself, often resulting in a person-in-need urinating over the side of the boat. This causes several issues. For one, the person-in-need may expose their private parts to onlookers at the shore or those on other nearby boats. Often the seas are rough and as a person-in-need leans over the side of a boat, the risk of falling overboard increases. Often, it is windy and urinating over the side of the boat often results in backsplash onto the side of the boat and onto the legs of the person-in-need.

What is needed is a portable urinal that is removably attached to the gunnel (or other location) of a boat.

SUMMARY

In one embodiment, a urinal for a boat is disclosed including an outer shell that has an enlarged opening for accepting liquids (e.g. urine) and a drain. The drain is interfaced to an opening on a bottom surface of the outer shell for draining the liquids away from the boat. In some embodiments, there is a support unit for installing the urinal into an orifice (e.g. fishing pole holder) of the boat.

In another embodiment, a method of urinating from a boat is disclosed including installing an appendage of a urinal into an orifice of the boat such that an enlarged opening in an outer shell of the urinal faces inwardly of the boat and a drain tube of the urinal faces outwardly away from a side of the boat. The drain tube is interfaced to a drain on the outer shell of the urinal then urinating into the enlarged opening such that urine flows to a bottom of the outer shell of the urinal through the drain and then through the drain tube, exiting away from the boat.

In another embodiment, urinal for a boat is disclosed including an outer shell that has an enlarged opening on a front surface for accepting liquids. There is a drain interfaced to an opening on a bottom surface of the outer shell and a support unit for installing the urinal into an orifice of the boat. The support unit has an appendage, a first end of which is interfaced to a bottom outside surface of the outer shell through a positioning mechanism and a distal second end of which is for inserting into the orifice of the boat.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 4:
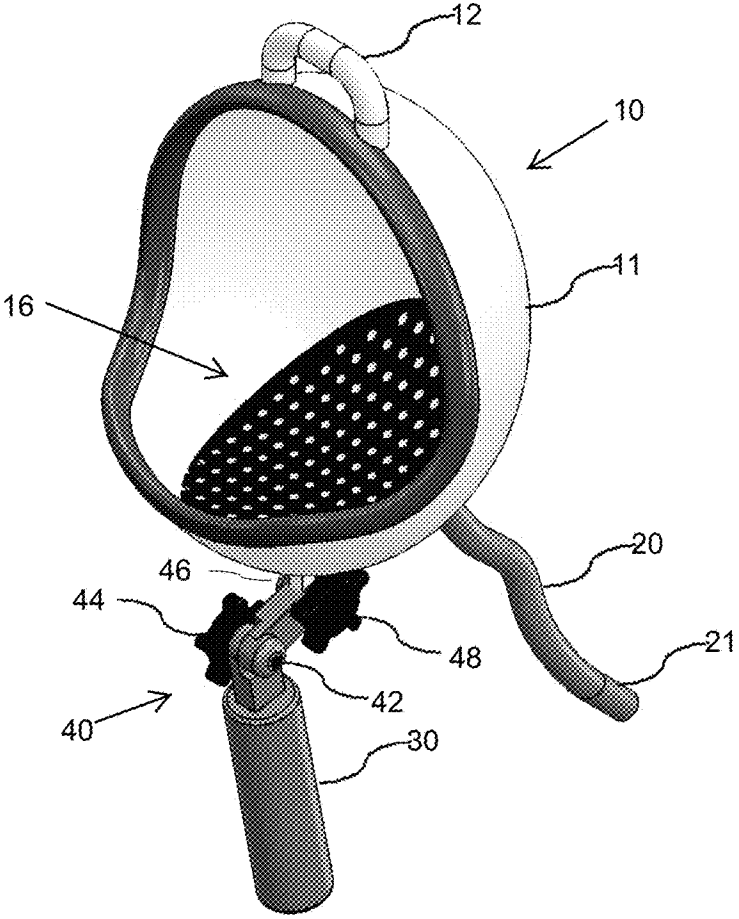
FIG. 4 illustrates a perspective view of the boat urinal.

Reference will now be made in detail to the presently preferred embodiments of the invention, examples of which are illustrated in the accompanying drawings. Throughout the following detailed description, the same reference numerals refer to the same elements in all figures.

Many boats, in particular, fishing boats have fishing pole holders into which a person places the butt-end of their fishing pole, for example, to hold the fishing pole while attending other activities. The remainder of this disclosure describes and claims a urinal device that in some embodiments, conveniently mounts into such a fishing pole holder, though it is fully anticipated that the urinal device be handheld or mount into any orifice of a boat, for example, a flag holder or a holder for a running light. Although the urinal for a boat is not shown mounted onto a boat, one skilled in the art will readily recognize how the urinal for a boat will mount and rest in any orifice of a boat such as s fishing pole holder orifice.

Figure 3:
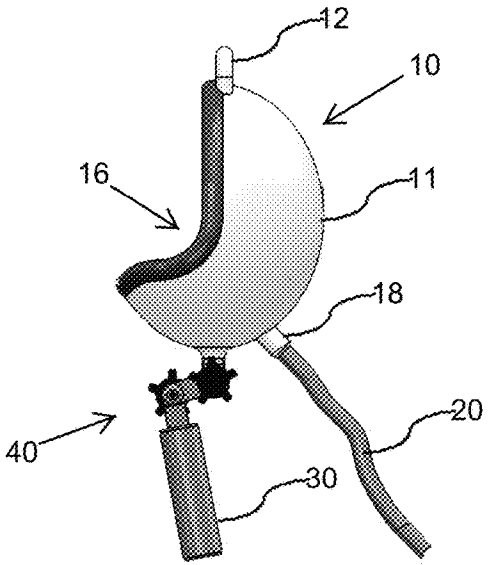
FIG. 3 illustrates a side-plan view of the boat urinal.
Figure 1:
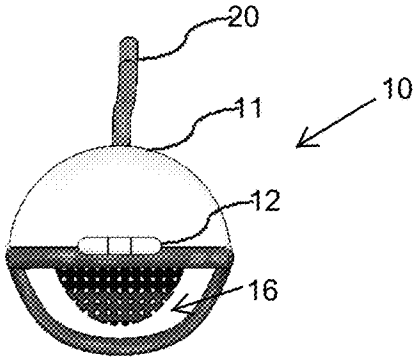
FIG. 1 illustrates a top-plan view of a boat urinal.
Figure 2:
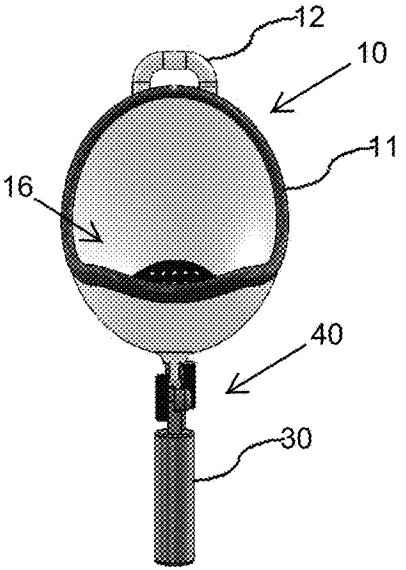
FIG. 2 illustrates a front-plan view of the boat urinal.

Referring to FIGS. 1-4, the urinal 10 for a boat is shown. The outer shell 11 of the urinal 10 is shown curved for properly directing urine splashes towards the bottom of the urinal 10 and for ease of cleaning, though there is no requirement for any particular shape or size. There is an enlarged opening 16 on a forward surface of the outer shell 11 for accepting liquids such as urine from a person on the boat. In some embodiments, there is a handle 12 affixed to an upper surface of the outer shell 11 of the urinal 10 for carrying and installing, though the handle 12 is not included in all embodiments.

At the bottom of the outer shell 11 is a drain 18 for exhausting of liquids from the urinal 10. The drain 18 includes a hole in the outer shell 11 through which such liquids will flow. Although it is anticipated that the drain 18 be interfaced to a drain tube 20 for directing the liquids away from the boat, there is no requirement for the drain tube 20 and in some embodiments, the drain 18 aims away from the boat and has no drain tube. In some embodiments, the drain tube 20 is a reservoir of any shape having a cap 21 at an end distal from the drain 18, thereby holding the liquid/urine within the outer shell 11 and drain tube 20 until a proper discharge location is available.

In some embodiments, the urinal 10 is handheld by the handle 12 and the user holds the urinal 10 by the handle 12 while urinating, draping the drain tube 20 over the side of the boat.

In some embodiments, the urinal 10 includes a support unit 40 that interfaces with an orifice of the boat, for example, the support unit 40 inserts into a fishing pole holder (not shown) during uses.

In some embodiments, the support unit 40 includes an appendage 30 that is sized and shaped to fit within the orifice of the boat (e.g. fishing pole holder) such as a tubular appendage (as shown). In such embodiments a first end of the appendage 30 is affixed directly to a bottom surface of the outer shell 11, for example, by an adhesive, weld, or fastener such as a brass fastener to reduce corrosion when exposed to urine.

In some embodiments, the support unit 40 includes further includes a positioning mechanism that permits adjustment of the position and angle of the outer shell 11 to compensate for the angle and location of the orifice (e.g. fishing pole holder) into which the appendage 30 is installed.

Often, fishing pole holders have a liner that is at an angle to the gunnel of the boat, for example, a 30-degree angle. In this embodiment, two knuckles or hinges 42/46 provide adjustment of the outer shell 11 after the appendage 30 is inserted into an orifice of the boat. In this embodiment, there are also two tightening knobs 44/48 for locking the knuckles or hinges 42/46 in place after adjustment. In such embodiments a first end of the appendage 30 is affixed or formed to interface with the first knuckle or hinge 42 and the first knuckle or hinge 42 is connected to the second knuckle or hinge 46. The second knuckle or hinge 46 is then interfaced to a bottom surface of the outer shell 11, for example, by an adhesive, weld, or fastener such as a brass fastener to reduce corrosion when exposed to urine.

Although, in the above example, two knuckles or hinges 42/46 are shown as an example of a positioning mechanism, there is no limitation on the number of two knuckles or hinges 42/46 or the type of positioning mechanism, all possible positioning mechanisms are anticipated. For example, in some embodiments, the outer shell 11 is connected to the appendage 30 by way of a flexible shaft that can be deformed by hand, yet remains as deformed until deformed again by hand.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A urinal for a boat, the urinal comprising:

an outer shell, the outer shell having an enlarged opening for accepting liquids;

a drain tube, the drain tube interfaced to a drain opening on a bottom surface of the outer shell, the drain tube for directing the liquids away from the boat; and a support unit for installing the urinal into an orifice of the boat, the support unit having an appendage and a positioning mechanism, a first end of the appendage is interfaced the positioning mechanism and the positioning mechanism is interfaced to a bottom outside surface of the outer shell, a distal second end of the appendage is for inserting into the orifice of the boat;

wherein the positioning mechanism comprises a hinge joint.

2. The urinal for the boat of claim 1, further comprising a handle, the handle mounted to an upper, outside surface of the outer shell for carrying and holding the urinal.

3. The urinal for the boat of claim 1, wherein the appendage is tubular in shape.

4. The urinal for the boat of claim 1, wherein the hinge joint includes a knob for locking the hinge joint in place.

5. The urinal for the boat of claim 1, wherein the positioning mechanism comprises at least two hinge joints.

6. The urinal for the boat of claim 5, wherein each of the at least two hinge joints includes a knob for locking the at least two hinge joints in place.

7. The urinal for the boat of claim 1, wherein the orifice of the boat is a fishing pole holder.

8. A method of urinating from a boat, the method comprising:

installing an appendage of a urinal into an orifice of the boat such that an enlarged opening in an outer shell of the urinal faces inwardly of the boat and a drain tube of the urinal faces outwardly away from a side of the boat, the drain tube interfaced to a drain on the outer shell of the urinal;

urinating into the enlarged opening;

urine flowing to a bottom of the outer shell of the urinal through the drain and through the drain tube, exiting away from the boat; and adjusting an angle of the outer shell of the urinal using a positioning mechanism that is interfaced between the appendage of the urinal and an outer, bottom surface of the outer shell.

9. The method of claim 8, wherein the positioning mechanism comprises at least one knuckle or hinge.

10. The method of claim 9, wherein each of the at least one knuckle or hinge includes a knob for locking each of the at least one knuckle or hinge after the step of adjusting.

11. A urinal for a boat, the urinal comprising:

an outer shell, a front of the outer shell having an enlarged opening for accepting liquids;

a drain tube, the drain tube interfaced to a drain opening on a bottom surface of the outer shell, the drain tube for directing the liquids away from the boat; and a support unit for installing the urinal into an orifice of the boat, the support unit having an appendage, a first end of the appendage is interfaced to a bottom outside surface of the outer shell through a positioning mechanism and a distal second end of the appendage is for inserting into the orifice of the boat; and wherein the positioning mechanism comprises at least one hinge joint.

12. The urinal for the boat of claim 11, wherein the at least one hinge joint includes a knob for locking the at least one hinge joint in place.

13. The urinal for the boat of claim 11, further comprising a handle, the handle mounted to an upper, outside surface of the outer shell for carrying and holding the urinal.

* * * * *